US007216452B1

(12) United States Patent
Hall

(10) Patent No.: US 7,216,452 B1
(45) Date of Patent: May 15, 2007

(54) ARMREST FOR HUNTING

(76) Inventor: Russell D. Hall, 2600 Jamie La., Breham, TX (US) 77833

( * ) Notice: Subject to any disclaimer, the term of this patent is extended or adjusted under 35 U.S.C. 154(b) by 0 days.

(21) Appl. No.: 11/407,419

(22) Filed: Apr. 20, 2006

(51) Int. Cl.
*F41C 27/00* (2006.01)

(52) U.S. Cl. ..... 42/94; 248/118; 89/37.04

(58) Field of Classification Search ..... 42/94; 89/37.04; 248/118, 118.1, 118.3, 118.5, 248/229.23, 228.4, 230.4, 231.51
See application file for complete search history.

(56) References Cited

U.S. PATENT DOCUMENTS 499,315 A * 6/1893 Borchardt ..... 89/132
2,847,909 A * 8/1958 Kester ..... 89/40.06
3,225,656 A 12/1965 Flahery et al.
4,575,964 A 3/1986 Griffin
5,345,706 A 9/1994 Brown
D395,070 S 6/1998 McGowan
5,930,931 A 8/1999 Watson
6,305,117 B1 * 10/2001 Hales, Sr. ..... 42/94
6,338,218 B1 * 1/2002 Hegler ..... 42/94
2004/0237372 A1 12/2004 Frye

* cited by examiner

*Primary Examiner*—Michael J. Carone
*Assistant Examiner*—Gabriel J. Klein
(74) *Attorney, Agent, or Firm*—Lawrence J. Gibney, Jr.

(57) ABSTRACT

This device will allow the hunter to stabilize his rifle during hunting so that he or she may obtain a good clean shot at the prey. It will consist of a pair of arms, which are attached to a mounting surface and an arm upon which to rest the hunter's arm and rifle.

9 Claims, 5 Drawing Sheets

ARMREST FOR HUNTING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to the ability to position one's arm while hunting. This may be important in the field or in a tree stand. Because this device will be exposed to the elements, it should be made of durable, non-corrosive material.

B. Prior Art

There are many other prior art references to hunting devices and in particular field or rifle rests. A representative example of this type of device can be found in Flaherty, U.S. Pat. No. 3,225,656. This is a device in which one rests a rifle during hunting. The structure in this case is different than is contemplated in the prior art.

Another device that can be found, which is specifically used for vehicles, can be found in Frye, U.S. Publication 2004/0237372. This device is mounted to a vehicle and supports a rifle.

BRIEF SUMMARY OF THE INVENTION

This is a device which enables a hunter to stabilize and rest his arm and his rifle during hunting. It is important to stabilize the rifle to achieve the best shot at the prey. It can be mounted to any sort of mounting structure, and this may include a tree stand, a pickup truck bed or a blind.

A front support member and a rear support member are connected to a main frame member upon which the hunter rests his arm and rifle. The main frame member may also be padded for additional comfort.

The front support member and rear support members are hollow and encase base arms, which telescope within the respective support members. A flat plate with a non-slip surface secures the device to the mounting structure.

Because the base arms telescope with the appropriate support members, this allows the device to be positioned exactly how the hunter desires it. Locking knobs provide a way to lock the base arms within both the front fixed support member and the rear support member so that the device can maintain its position.

Because this device will be exposed to the elements and extremes in all different types of environmental conditions, it should be constructed of durable, non-corrosive material. The material that is selected and used should be able to support the weight of a rifle and a hunter's arm.

It is an object of this device to create a device that can support the weight of a rifle and a hunter's arm so that the rifle can be steady when hunting.

DETAILED DESCRIPTION OF THE EMBODIMENTS

Figure 1:
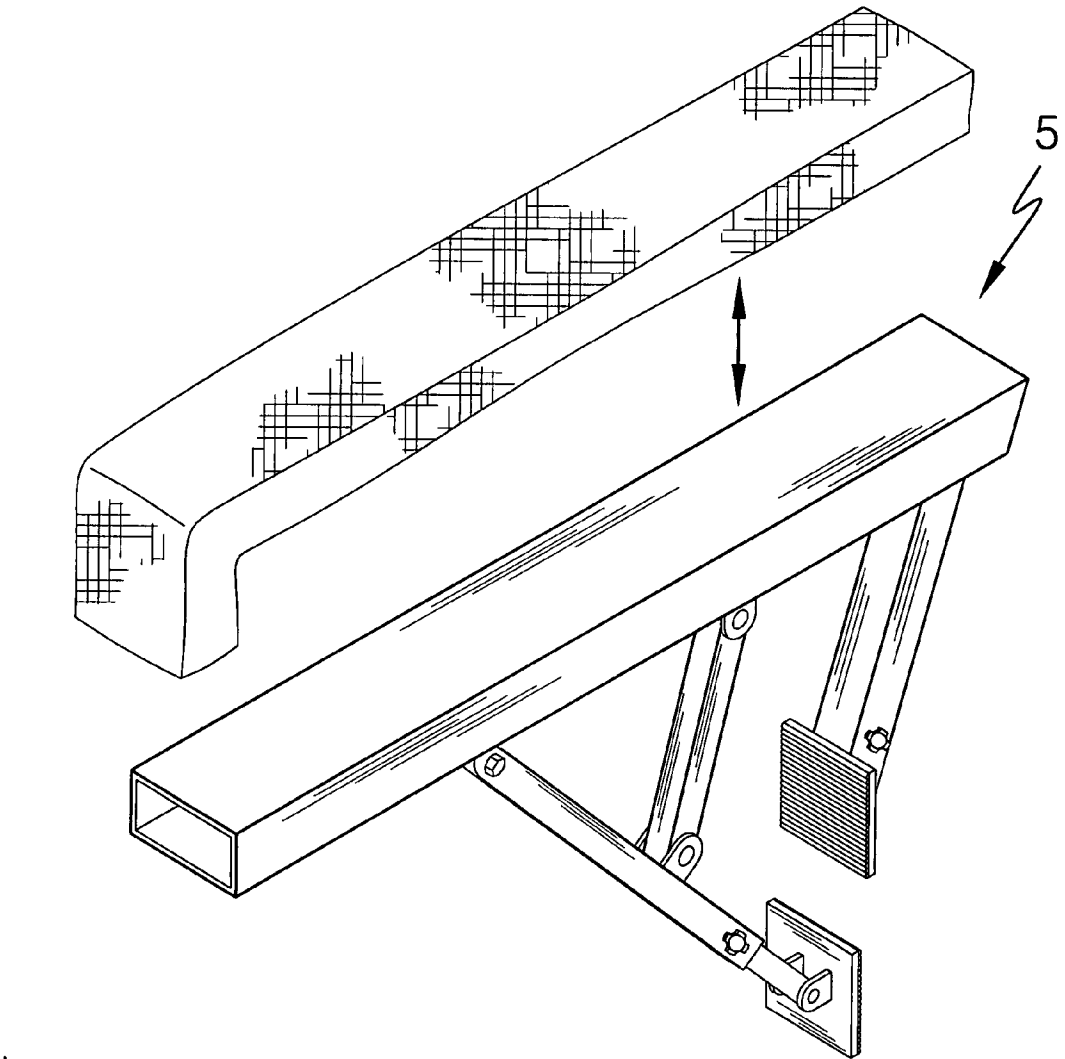
FIG. 1 is an isometric view of the device not mounted to any structure.

The device 5 allows a hunter to steady a rifle during hunting. This is important in order to get a clean shot at the prey. FIG. 1 Because the device will be exposed to extremes in temperature and extremes in weather conditions, it should be constructed of durable, non-corrosive material.

It will be comprised of a flat frame member 10, a rear support member 22 as well as a front support member 20. The rear support member 22 and front support member 20 are connected to the underside of the frame member 10.

Figure 2:
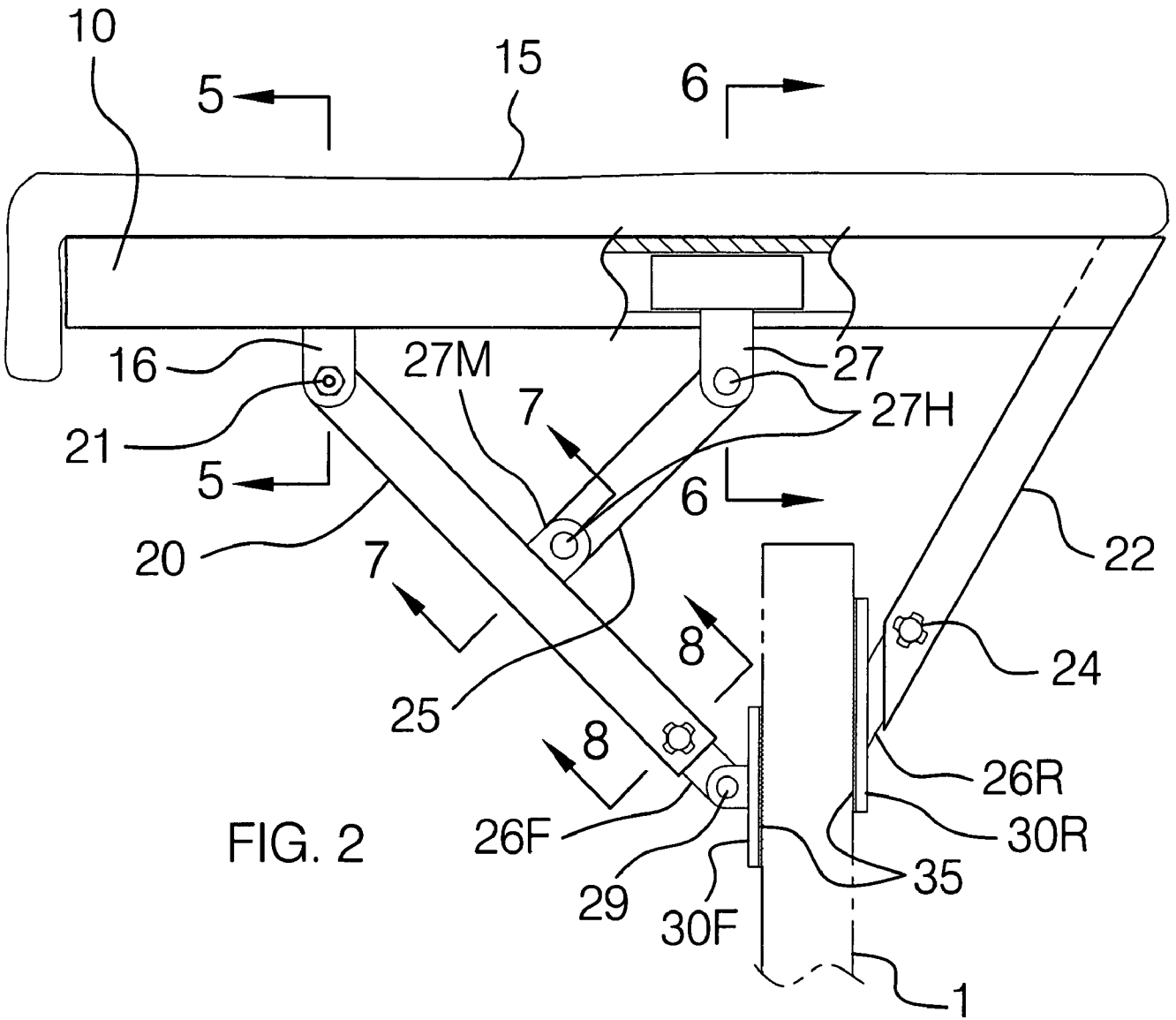
FIG. 2 is a side view of the device with the mounting structure indicated by the dash lines.

Both the rear support member 22 and the front support member 20 are hollow and base arms, 26R and 26F, are placed within the respective support members. These base arms have the ability to telescope in order to properly adjust this device, depending on the hunter and the particular conditions. Locking knobs 24 at one end of both the rear support member 22 and the front support member 20 provide a means to secure the device 5 once in position. FIG. 2

The device is mounted to a mounting surface 1, which can either be a pickup truck bed, a tree stand or the side of a blind. The mounting surface 1 should be of sufficient strength to support the device and the weight of the hunter's arm and rifle. One of the telescoping base arms, 26R, is positioned within the rear support member 22 and is flanged at one end with a flat plate 30R. On one side of the flat plate 30R is a non-slip surface 35, which, when the device is mounted, will come in contact with the mounting structure 1.

Similarly a plate on the front base arm, 30F, is also provided to secure the device to the other side of the mounting structure 1. This plate 30F is allowed to pivot around a pivot point 29. This ability to pivot is important to enable the hunter to correctly position the device. A non-slip surface 35 is also provided on the side of the base arm 30F, which comes in contact with the mounting structure. When the device is installed, the flat plates, 30F and 30R, secure the device to the mounting structure 1.

Figure 8:
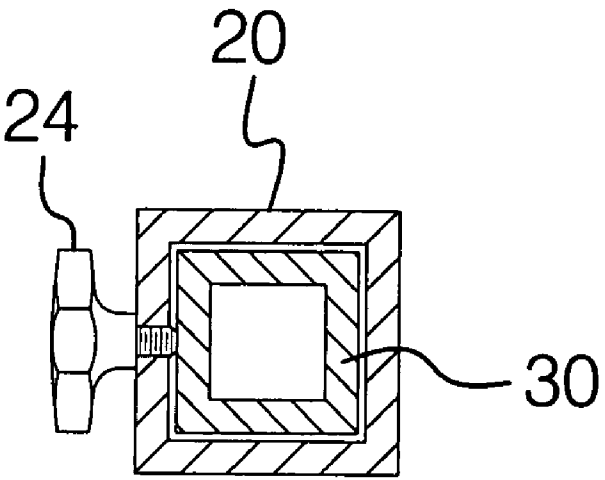
FIG. 8 is a view according to line 8—8 on FIG. 2.
Figure 7:
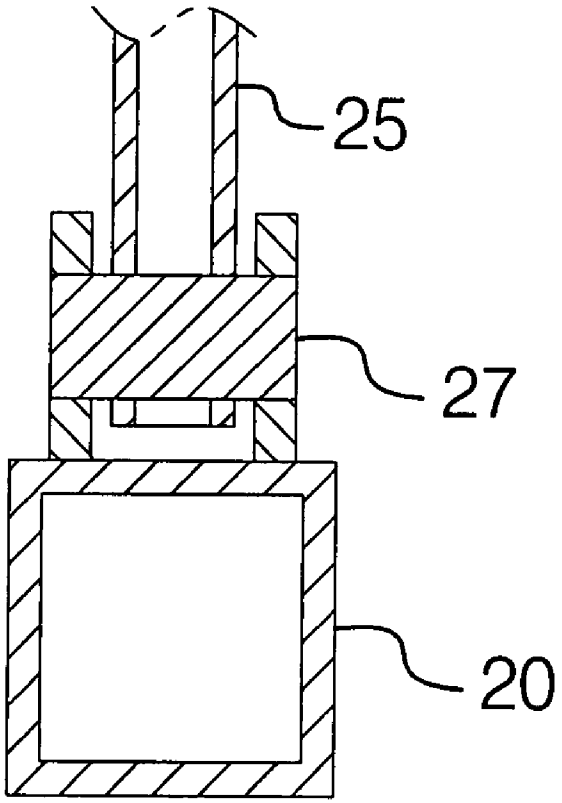
FIG. 7 is a view according to line 7—7 on FIG. 2.

Locking knobs 24 are positioned for the base arms, 30F and 30R, to be secured in place. The locking knobs are comprised of a threaded portion which impacts a portion of the surface of the base arm that is housed within the respective front and rear support members. One end of the locking knob is a handle or knob which can be turned to apply pressure against the respective base arm. FIG. 8

Extending outward and upward from the mounting surface 1 is the rear support member 22 and the front support member 20. The front support member 20 and rear support member 22 are connected to the underside of the main frame 10. The rear support member 22 is likely to be welded to the back portion of the main frame. A bolt and nut combination may also be used to secure the rear support member to the main frame member.

Figure 4:
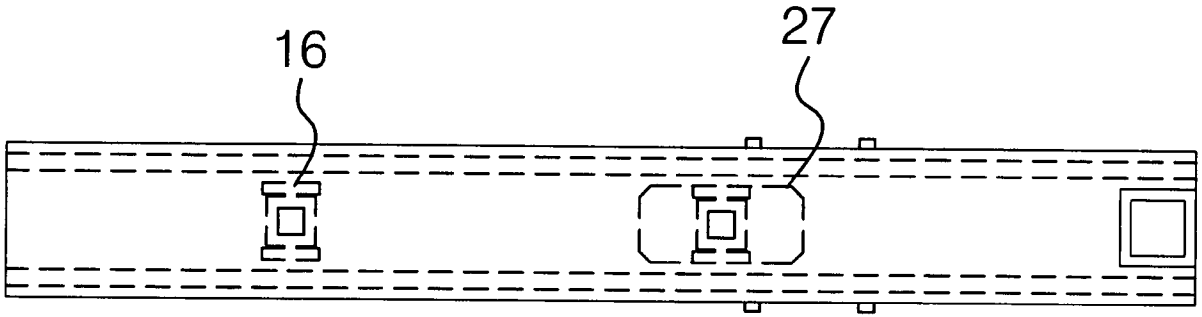
FIG. 4 is a top view of the device.
Figure 3:
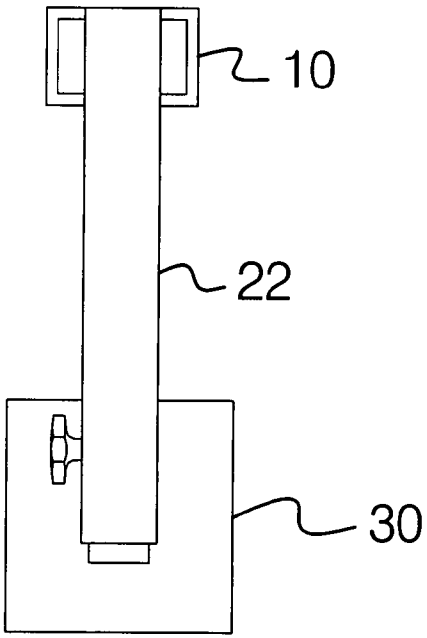
FIG. 3 is a back view of the device.
Figure 6:
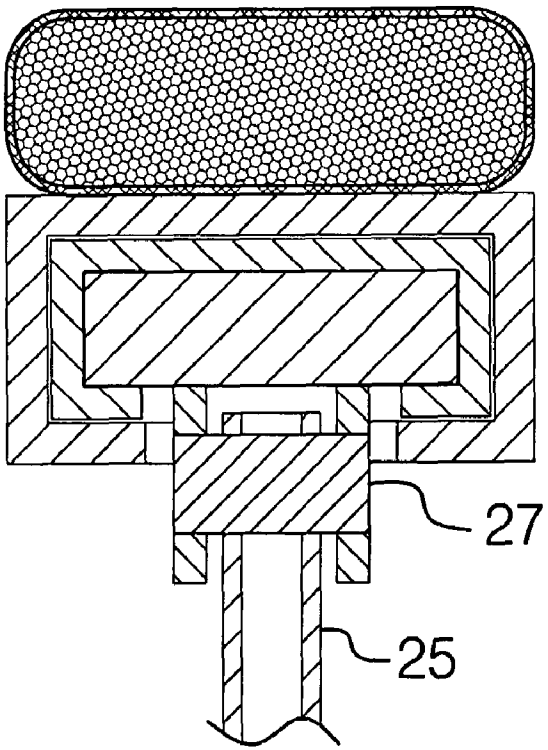
FIG. 6 is a view according to line 6—6 on FIG. 2.
Figure 5:
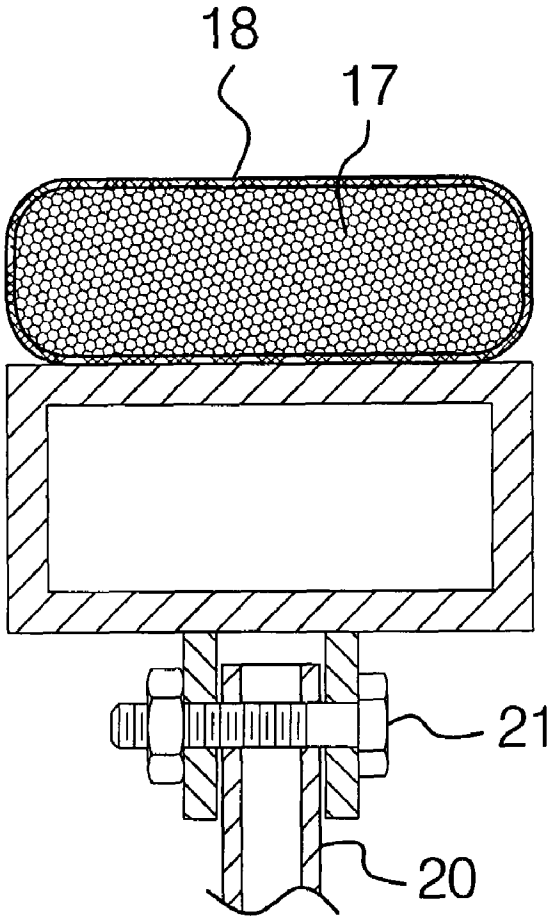
FIG. 5 is a view according to line 5—5 on FIG. 2.

The front support member 20 is connected to a front protrusion 16, which extends vertically downward from the underside of the frame member 10. The front protrusion 16 is likely to be a piece of stock. A hole in the middle of the protrusion allows the means of connection 21 such as a nut and bolt to pass through the hole in the protrusion and secure the front support member 20. Another alternative means of connection may also be a bolt with a cotter pin. FIG. 4

In the approximate middle of the front support 20 is a middle support member 25, which is connected to one side of the front support member 20 by means of a midpoint protrusion and a middle protrusion 27 on the underside of the frame member 10. The middle protrusion 27 is connected to the frame member 10, probably by welding. A means of connection for the middle sliding member 25 allows the user to maintain the appropriate vertical height of the device 5.

The middle support member 25 is connected at one end to the middle protrusion 27 and at the opposite end to the midpoint protrusion 27M on the front support member 20. Separate pieces of stock with holes in the middle allow the means of connection 27H to pass through the hole. This means of connection allows the device to pivot for correct positioning. This means of connection will probably be a rivet or a bolt and nut. The means of connection for the middle protrusion 27 and midpoint protrusion 27M should allow the device to move up and down.

The main frame member 10 is an elongated piece of material, probably steel, that will be durable enough to support the weight of the rifle as well as the hunter's arm. The frame member 10 will be attached to the rear support 22 at one end, to the middle protrusion 27 from the frame member 10 and to the front protrusion 16 at predetermined locations on the underside of the frame member 10.

In order to add comfort to the device, a comfort pad 15 is provided for the top frame. The comfort pad 15 probably has a foam core 17 as well as a leather or vinyl covering 18 to protect it from the environment. FIG. 1

All materials that are used in the construction of this device must be durable and preferably non-corrosive because of exposure to the elements and extremes in temperatures.

The inventor claims:

1. A device to rest a rifle during hunting which is comprised of:

a. a frame member;

wherein the frame member provides the area to rest the hunter's arm and the hunter's weapon;

wherein the frame member is of predetermined thickness, length and width;

wherein the frame member is attached to a rear support member;

wherein the frame member is attached to a front support member;

wherein the frame member is attached to a middle support member;

wherein protrusions on the underside of the frame member provide a means to connect the front support member and middle support member;

b. a front support member;

wherein the front support has a first end and a second end;

wherein the first end of the front support member is connected to a protrusion from the underside of the frame for that purpose;

wherein the front support member is hollow;

wherein a base arm is placed within the front support member and protrudes from the second end of the front support member;

wherein a means to secure the front support member to the mounting structure is provided;

c. a middle support;

wherein a middle support is positioned approximately in the middle of the front fixed support and extends towards a protrusion, which extends vertically down from the underside of the main frame between the connection point for the front support and the connection point for the rear support;

wherein the middle support member is connected to the underside of the frame member;

wherein the means to connect the middle support is allowed to pivot;

d. a rear support member;

wherein the rear support member has a first end and a second end;

wherein the first end of the rear support member is connected to the frame member;

wherein the rear support is hollow;

wherein a base arm extends from the second end of the rear support member;

wherein a means to lock the base arm in the rear support member is provided;

e. base arms;

wherein a first base arm is contained within the rear support member;

wherein a second base arm is contained within the front support member;

wherein the base arms have a first end and a second end;

wherein a portion of the first end of each of the base arms is contained with the respective front support member and rear support member;

wherein a flat plate is secured to the second end of the respective front support member and rear support members;

wherein locking knobs are provided to lock the base arms in position relative to the support members;

f. means to lock the base arms;

wherein a means to lock the base arms in position is provided;

said means to lock has a first end and a second end;

said first end is a knob;

said second end is a threaded portion that contacts the base arm in the respective front support and rear support members;

g. non-slip pad;

wherein a non-slip pad is provided on one side of the flat plates of the base arm;

said non-slip pads secure the device to a mounting structure;

h. a pad;

wherein the pad covers the frame member;

said pad is cushioned.

2. The device as described in claim 1 wherein the means of connection for the front support member to the frame member is a nut and bolt.

3. The device as described in claim 1 wherein the means of connection for the front support member is a bolt with a cotter pin.

4. The device as described in claim 1 wherein the means of connection for the rear support member is welding.

5. The device as described in claim 1 wherein the means of connection for the rear support member is a bolt with a cotter pin.

6. The device as described in claim 1 wherein the means of connection for the middle support member is a nut and bolt.

7. The device as described in claim 1 wherein the means of connection for the middle support member is a bolt with a cotter pin.

8. The device as described in claim 1 wherein a plurality of locking knobs to lock the base arms in position are provided.

9. The device as described in claim 1 wherein the flat plate for the front support member is allowed to pivot.

* * * * *